US010087680B1

(12) United States Patent
Hall et al.

(10) Patent No.: US 10,087,680 B1
(45) Date of Patent: Oct. 2, 2018

(54) BATTERY-POWERED WINDOW COVERING

(71) Applicants: David R. Hall, Provo, UT (US); Emily Brimhall, Alpine, UT (US); Austin Carlson, Provo, UT (US); Jedediah Knight, Provo, UT (US)

(72) Inventors: David R. Hall, Provo, UT (US); Emily Brimhall, Alpine, UT (US); Austin Carlson, Provo, UT (US); Jedediah Knight, Provo, UT (US)

(73) Assignee: Hall Labs LLC, Provo, UT (US)

( * ) Notice: Subject to any disclaimer, the term of this patent is extended or adjusted under 35 U.S.C. 154(b) by 2 days.

(21) Appl. No.: 15/472,090

(22) Filed: Mar. 28, 2017

(51) Int. Cl.

| | |
|---|---|
| ***A47H 5/00*** | (2006.01) |
| ***E06B 3/48*** | (2006.01) |
| ***E06B 3/94*** | (2006.01) |
| ***E06B 9/06*** | (2006.01) |
| ***E06B 9/322*** | (2006.01) |
| ***E06B 9/72*** | (2006.01) |
| ***E06B 9/323*** | (2006.01) |

(52) U.S. Cl.
CPC ..... *E06B 9/322* (2013.01); *E06B 9/323* (2013.01); *E06B 9/72* (2013.01)

(58) Field of Classification Search
CPC . E06B 9/322; E06B 9/323; E06B 9/72; E06B 9/68; E06B 9/70; E06B 9/74
See application file for complete search history.

(56) References Cited

U.S. PATENT DOCUMENTS

| | | | | |
|---|---|---|---|---|
| 7,264,034 | B2 * | 9/2007 | Lin | E06B 9/32 160/168.1 P |
| 9,722,220 | B2 * | 8/2017 | Lemaitre | H01M 2/10 |
| 2003/0168188 | A1 * | 9/2003 | Wen | E06B 9/308 160/168.1 P |
| 2004/0123960 | A1 * | 7/2004 | Jorgensen | E06B 9/40 160/310 |
| 2007/0175599 | A1 * | 8/2007 | Froese | E06B 9/386 160/168.1 R |
| 2010/0154999 | A1 * | 6/2010 | Oh | E06B 9/322 160/7 |
| 2012/0255689 | A1 * | 10/2012 | Blair | E06B 9/32 160/331 |
| 2015/0179994 | A1 * | 6/2015 | Lemaitre | E06B 9/72 160/310 |
| 2015/0288316 | A1 * | 10/2015 | Hall | H02P 29/027 318/434 |

(Continued)

*Primary Examiner* — Brian D Mattei

(57) ABSTRACT

Embodiments of motorized window coverings are described herein. Various embodiments may include a shade, a shade deployment assembly, one or more batteries, and wiring. The shade may include an upper end and a lower end opposite the upper end. The shade deployment assembly may be disposed at the upper end and may deploy the shade. The shade deployment assembly may comprise a rotatable element, a motor that rotates the rotatable element, and one or more mounting brackets. The mounting brackets may mount the shade deployment assembly to a surface. The shade may be directly connected to the shade deployment assembly, such as to the rotatable element. The battery may be removably connected to the shade at the lower end. The one or more batteries may power the motor. Wiring may be disposed in the shade. The wiring may electrically couple the motor to the one or more batteries.

20 Claims, 16 Drawing Sheets

(56) References Cited

U.S. PATENT DOCUMENTS

| | | | | |
|---|---|---|---|---|
| 2017/0167193 | A1* | 6/2017 | Slivka | E06B 9/72 |
| 2017/0234066 | A1* | 8/2017 | Graybar | E06B 9/322<br>475/149 |
| 2017/0298690 | A1* | 10/2017 | Mullet | E06B 9/72 |
| 2018/0112463 | A1* | 4/2018 | Derk, Jr. | E06B 9/72 |
| 2018/0135351 | A1* | 5/2018 | Walker | E06B 9/264 |

* cited by examiner

BATTERY-POWERED WINDOW COVERING

CROSS-REFERENCES

This application makes reference to U.S. Pat. No. 9,540,817 to David R. Hall et al., entitled "Motorized Gearbox Assembly with Through-Channel Design," and is incorporated herein in its entirety by reference.

TECHNICAL FIELD

This invention relates generally to the field of window coverings and more specifically to motorized, battery-powered window coverings.

BACKGROUND

Many window blinds and shades are becoming motorized. This presents new problems in the design of such devices. One such problem includes powering the motor. Some solutions include using batteries. Some batteries are disposed outside the shade, such as outside the headrail or tube. However, this presents aesthetic problems, as well as problems exposing the battery to environmental conditions. Some manufacturers have placed batteries inside the headrail or tube. Unfortunately, access to the batteries is still a challenge. In some cases, the window blind or shade must be removed to replace the batteries. In some roller shade cases, the shade must be completely unrolled and the tube exposed to remove and replace the batteries. This can be problematic if the batteries are completely dead, and can be inconvenient whether the batteries are dead or not. Thus, there is still room for improvement.

SUMMARY OF THE INVENTION

Embodiments of motorized window coverings are described herein that address at least some of the issues described above in the Background. Various embodiments may include a shade, a shade deployment assembly, one or more batteries, and wiring. The shade may include an upper end and a lower end opposite the upper end. The shade deployment assembly may be disposed at the upper end and may deploy the shade to cover a window. The shade deployment assembly may comprise a rotatable element, a motor and gear assembly that rotates the rotatable element, and one or more mounting brackets. The mounting brackets may mount the shade deployment assembly to a surface. The shade may be directly connected to the shade deployment assembly, such as to the rotatable element. The battery may be removably connected to the shade at the lower end. The one or more batteries may power the motor. Wiring may be disposed in the shade. The wiring may electrically couple the motor to the one or more batteries.

BRIEF DESCRIPTION OF THE DRAWINGS

A more particular description of the window covering summarized above is made below by reference to specific embodiments. Several embodiments are depicted in drawings included with this application, in which.

DETAILED DESCRIPTION

A detailed description of embodiments of various window covering embodiments is provided below with examples in the appended figures. Those of skill in the art will recognize that the components of the invention as described by example in the figures below could be arranged and designed in a wide variety of different configurations. Thus, the detailed description of the embodiments in the figures is merely representative of embodiments of the invention, and is not intended to limit the scope of the invention as claimed.

The described embodiments do not form an exhaustive list of all potential embodiments of the claimed invention; various combinations of the described embodiments are also envisioned, and are inherent from the descriptions of the embodiments below. Additionally, embodiments not described below that meet the limitations of the appended claims are also envisioned, as is recognized by those of skill in the art.

Figure 2A:
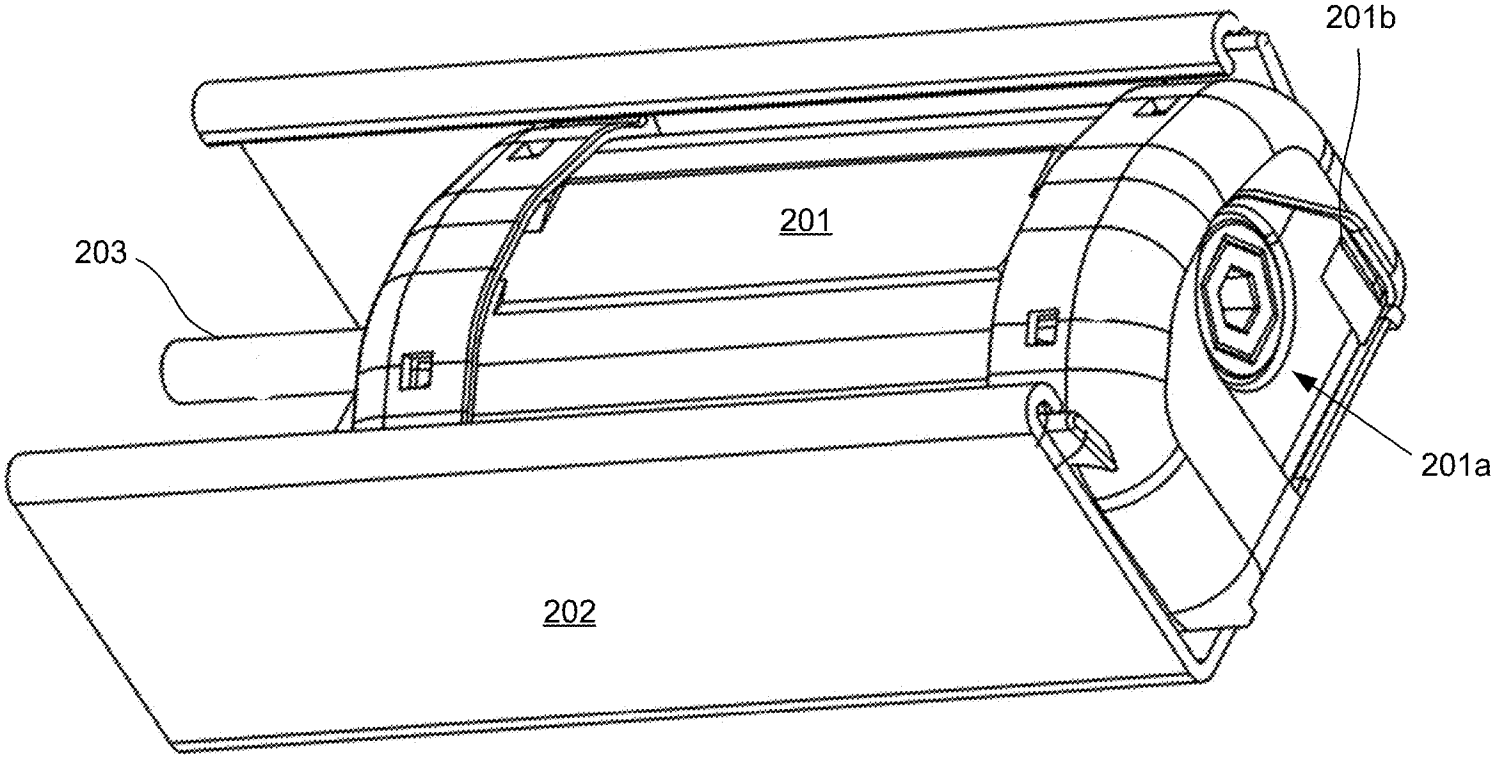
FIGS. 2A-B depict views of an example motor for use in the headrail of a motorized window covering.
Figure 2B:
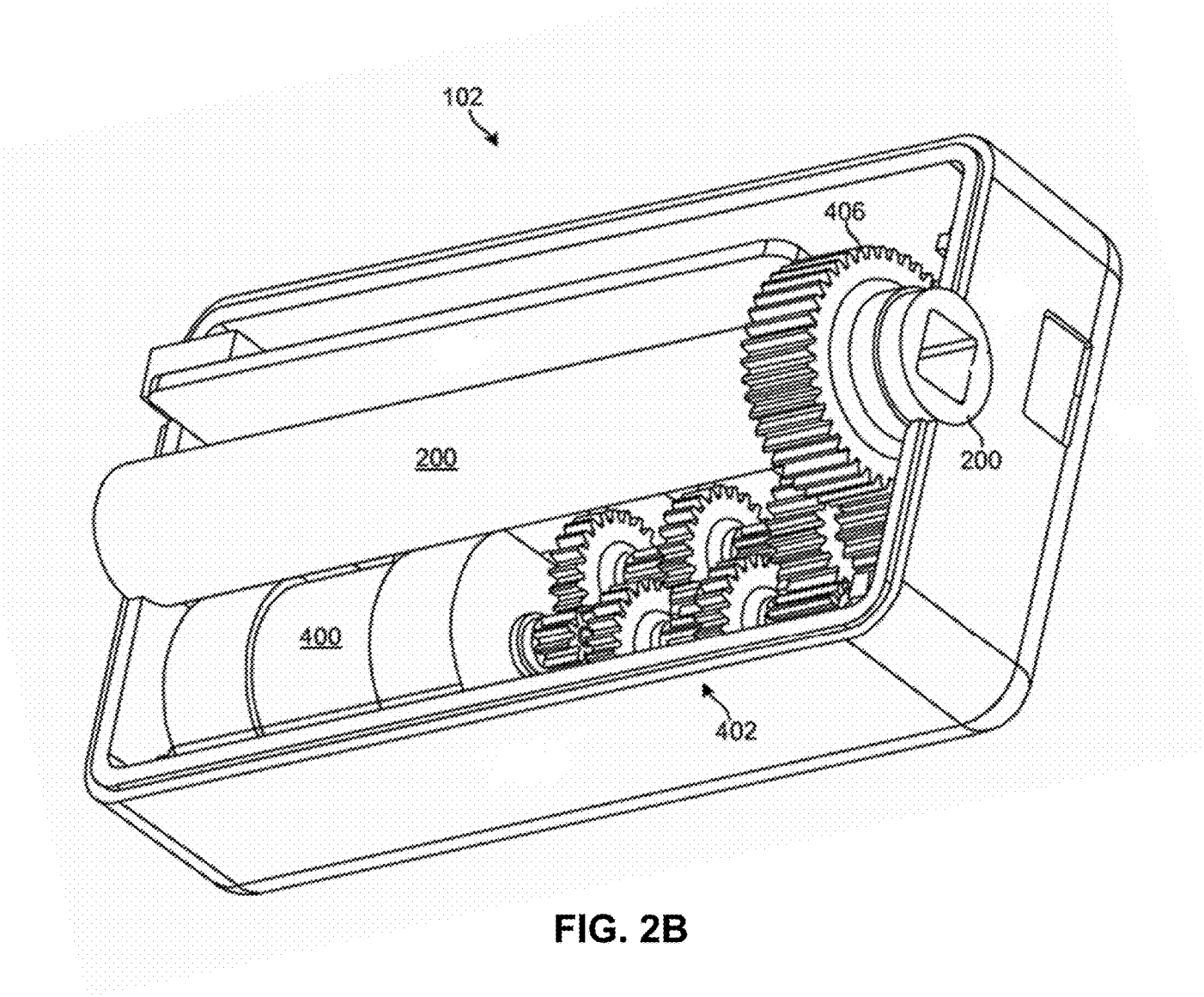

Each FIG. is described separately from each other FIG, except that some sub-FIGs. of the same FIG. (e.g., FIG. 3A and FIG. 3B) are described with a single description. Such is indicated by the use of the same numbers on each related FIG. However, FIGS. 2A and 2B are described and numbered separately.

Embodiments of motorized window coverings are described herein. Various embodiments may include a shade, a shade deployment assembly, one or more batteries, and wiring. The shade may include an upper end and a lower end opposite the upper end. The shade deployment assembly may be disposed at the upper end and may deploy the shade to cover a window. The shade deployment assembly may comprise a rotatable element, a motor that rotates the rotatable element, and one or more mounting brackets. The mounting brackets may mount the shade deployment assembly to a surface. The shade may be directly connected to the shade deployment assembly, such as to the rotatable element. The battery may be removably connected to the shade at the lower end. The one or more batteries may power the motor. Wiring may be disposed in the shade. The wiring may electrically couple the motor to the one or more batteries.

Embodiments of the motorized window covering may include various types of interior and/or exterior window coverings. Such window coverings may include blinds, shutters, shades and/or drapes. Specific embodiments may include slat blinds, venetian blinds, vertical blinds, roman blinds, mini blinds, micro blinds, louvers, jalousies, brise soleil, pleated blinds, interior shutters, plantation shutters, café shutters, roller shades, cellular shades, roman shades, pleated shades, bamboo shades, sheer shades, curtains, drapes, and/or valances, among others.

The shade may comprise any of a variety of structures and/or materials. In various embodiments, the shade may include rigid slats and/or a flexible panel. The shade may be formed of wood, aluminum, bamboo, vinyl, one or more synthetic polymers, fabric, cotton, polyester, nylon, polyethylene, polyvinylidene chloride, LDPE, or combinations thereof. The wiring may be incorporated and/or integrated into the shade in a variety of ways. For example, the shade may include a flexible panel, and the wiring may be integrated into the flexible panel. The flexible panel may be comprised of a woven material, such as a woven fabric, and the wiring may be woven into the flexible woven panel similar to how strands forming the woven panel are woven together. The wiring may include one or more wires, each wire having a thickness equal to the thickness of one strands plus or minus 50% of the thickness of the strand. The wires may include non-conductive sheathing, and may be woven into the fabric. Such may be accomplished by alternating one or more bobbins of wire with bobbins of strands. In some embodiments, the flexible panel may for comprised of one or more layers of thermoformed polymer material. In some embodiments, the wiring may be pressed between two layers of polymer heated above the polymer's glass transition temperature. In other embodiments, the wiring may be pressed into a single layer of heated polymer. In some embodiments, the shade may include one or more strings connected to the rotatable element. The strings may include the wiring.

The shade deployment assembly may correspond to a variety of different window covering types. The assembly may include a headrail, the deploying mechanism, and/or one or more mounting brackets. The rotatable element may include a roller tube and/or a tilt rod. The rotatable element may be comprised of one or more materials, including wood, aluminum, steel, carbon fiber, fiberglass, PVC, ABS, and/or combinations thereof, among others. The rotatable element may be connected to the shade, such as by one or more strings, cords, glue, tape, rivets, and/or pins, among other means. The mounting brackets may include means for mounting the shade deployment assembly to a mounting surface, such as a wall and/or window frame.

The motor and gear assembly may include various components, including a stator, a rotor, a transmission, and/or a control unit. The control unit may include hardware memory, one or more hardware processors, and/or one or more transceivers. The hardware memory may store instructions that, when executed by the one or more processors, cause the stator to rotate the rotor and transmit the rotation of the rotor via the transmission to the rotatable element. The instructions may include various directions and/or durations of rotation. The instructions may include detecting hard stops of the deploying mechanism and storing positions of the deploying mechanism corresponding to the hard stops. Such may be accomplished, for example, using one or more position encoders. Such position encoders may include, for example, one or more diametrically magnetized magnets.

The battery may be disposed in, on, or may form a bottom portion of the motorized window covering. The bottom portion may correspond to a variety of different window covering types. In various embodiments, the bottom portion may be an endmost portion of the shade opposite an end of the shade connected to the rotatable element. For example, in some venetian blind embodiments, the bottom portion may include a bottom slat. The bottom slat may be thicker than other slats of the shade, and/or may be partially hollowed. The one or more batteries may be disposed in and/or on the bottom portion, or may form the bottom portion. The bottom slat may include a detachable panel over the one or more batteries. In some roller shade embodiments, the bottom portion may include a weight at the end-most portion of the shade opposite the end connected to the rotatable element. The shade may be wrapped around the weight, or may be otherwise connected to the weight. The weight may be partially hollowed to include space for the one or more batteries, and may include a removable end cap over the one or more batteries that allows a user to access and/or exchange the batteries. In various embodiments, the one or more batteries may be disposed in a housing connected to the shade. The housing may include a removable panel and/or cap that may be removed to allow access to the one or more batteries.

The bottom portion may include one or more control buttons electrically coupled to the motor by the wiring. The one or more control buttons may be disposed at the same end of the shade as the one or more batteries. The control buttons may include buttons for lowering and/or raising the window covering, tilting blind slats, and/or programming the motor control unit. The control buttons may be disposed on an external surface of the bottom portion and/or the shade. In some embodiments, one or more of the control buttons may be disposed and/or hidden beneath an external design feature of the bottom portion and/or the shade. The control buttons may be visually hidden beneath the external design feature. For example, a layer of vinyl may be disposed on a bottom slat of a set of venetian blinds. The layer of vinyl may cover the control buttons. As another example, the shade may wrap around a tube, and the control buttons may be disposed on the tube beneath the shade. The control buttons may communicate with the motor control unit to deploy the shade.

In some embodiments, the bottom portion and/or the one or more batteries may be integral with the shade. For example, in some vertical blinds embodiments, the bottom portion and/or the one or more batteries may include a length of one or more bottom ends of one or more vertical blind slats. In some horizontal blind embodiments, the bottom portion and/or the one or more batteries may include a bottom-most slat connected by one or more strings to the other slats of the shade. In some roller shade embodiments, the bottom portion and/or the one or more batteries may include a weight wrapped in a bottom-most portion of the flexible panel. However, in other embodiments, the bottom portion and/or the one or more batteries may be detachable from the shade. For example, the shade may include a flexible panel including one or more magnets disposed at a bottom end of the shade. The bottom portion and/or the one or more batteries may include a tube with a slot running longitudinally along the tube having a magnetic face that corresponds to the magnets disposed at the bottom end of the shade. As another example, the shade may include a set of horizontal slats connected by strings. Ends of one or more of the strings may include clips and/or magnets that connect to a detachable bottom slat that forms the bottom portion and/or the one or more batteries.

The bottom portion may include various electrical components in addition to the one or more batteries. For example, the bottom portion may include a housing within which the one or more batteries are disposed. The housing may include a charging port electrically coupled to the one or more batteries. The housing may include a data port electrically coupled to the one or more batteries of the motor. In such embodiments, at least some of the wiring comprises one or more data lines connecting the data port to the motor control unit. In embodiments including the control buttons in the bottom portion, the wiring may connect the control buttons to the motor control unit. In some embodiments, the bottom portion may include a wireless transceiver. The wireless transceiver may communicate wirelessly with the motor control unit transceiver.

The one or more batteries may include rechargeable batteries and/or disposable batteries. The batteries may include various lithium ion batteries and/or alkaline batteries. The batteries may be disposed within the bottom portion.

The wiring may be embodied in any of a variety of ways. For example, the shade may include one or more strings connecting vertical slats to the rotatable element. The strings may include the wiring, such as incorporating the wiring into at least one of the strings. Such may be accomplished by winding the wiring into the one or more strings. In some embodiments, the wiring may include a set of individually sheathed wires, or sets of collectively sheathed wires. The sets of wires may be interwoven to form at least one of the strings. The coloring of the sheathing may correspond to a color scheme of the shade, such as the other strings, to camouflage the wiring in the shade. The wiring may have an ampacity ranging from 3 Amps to 20 Amps. The ampacity may correspond to individual wires of the wiring or the wiring collectively. In embodiments where the wiring includes one or more sets of wires, each wire of the set of wires may be electrically coupled to a monolithic conductor. The monolithic conductor may be disposed between the wiring and the motor. The monolithic conductor may be connected to the shade deployment assembly and/or electrically coupled to the motor. A second monolithic conductor may be connected to the bottom portion. The monolithic conductors may aggregate current carried by the wires of the wiring and deliver the current from the batteries to the motor. The monolithic conductor may include a strip and/or wire formed of copper. In embodiments where the monolithic conductor is a wire, the monolithic conductor may have a gauge equal to the combined gauge of the wiring.

Various specific embodiments of the general window coverings and window covering components described above are depicted in the appended FIGs. and described below regarding the appended FIGs.

Figure 1:
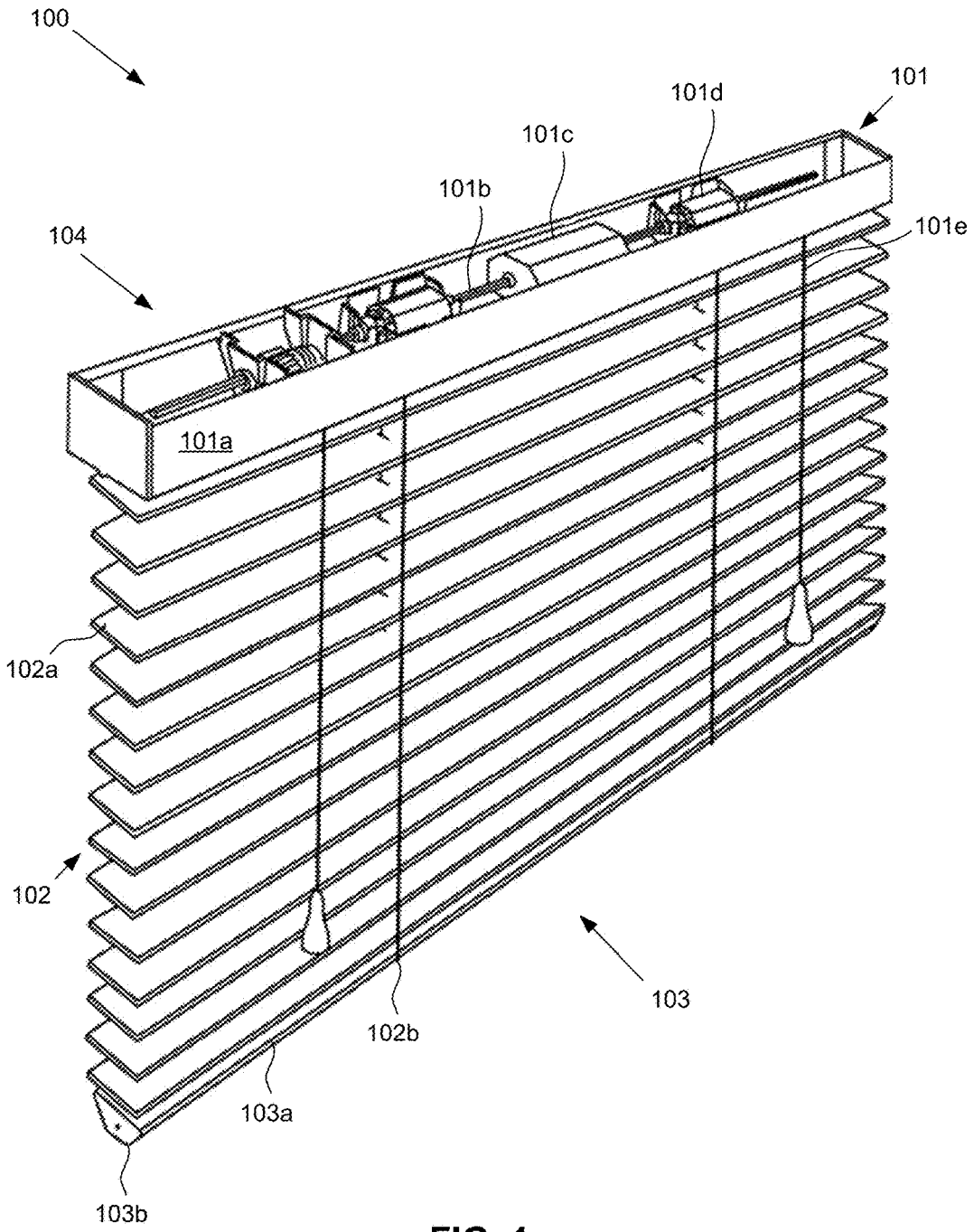
FIG. 1 depicts a venetian blind.

FIG. 1 depicts a venetian blind. The venetian blind 100 includes a shade deployment assembly 101, a shade 102, and a lower end 103 of the shade. The shade deployment assembly is disposed at an upper end 104 of the shade. The shade deployment assembly includes a headrail 101*a*, a tilt rod 101*b*, a motor 101*c*, bobbins 101*d*, and manual control strings 101*e*. The tilt rod passes through the motor and the bobbins, connecting the motor to the bobbins. The control strings allow for winding of the bobbins and tilting of the bobbins. The shade includes slats 102*a* and strings 102*b*. The strings connect the slats to the bobbins, thereby enabling tilting and raising/lowering of the slats. Wiring is also woven into the strings, the wiring electrically coupled to the motor. The bottom portion includes tube 103*a* with removable end cap 103*b*. Batteries are disposed within the tube and are electrically coupled to the motor via the wiring. The batteries may be accessed by removing the end cap.

FIGS. 2A-B depict an example motor and gear assembly for use in the headrail of a motorized window covering. In FIG. 2A, the motor and gear assembly 201 is disposed within the headrail 202. A tilt rod 203 passes through the motor in a channel 201*a*. The motor includes an electrical wiring port 201*b* that electrically couples the motor to power and/or data. The headrail supports the motor and enables the motor to turn the tilt rod by providing a counter-force to the rotation of the motor. In FIG. 2B, various internal components within the motor and gear assembly are illustrated. As shown, the motor and gear assembly 102 includes a motor 400 and a power transmission system 402 having one or more stages of gears to reduce the gear ration of the motor. In certain embodiments, the gear ratio may be between 100:1 and 1000:1. The instant inventors have found that a gear ration of 720:1 (i.e., 720 turns of the motor 400 produces 1 turn of the output shaft 200) works well in the present application. As shown, the power transmission system drives a main gear 406 coupled to the output shaft 200. The output shaft may, in turn, be used to drive the tilt rod (not shown). More detailed depictions of similar embodiments are found in U.S. Pat. No. 9,540,817 to David R. Hall et al., entitled "Motorized Gearbox Assembly with Through-Channel Design," particularly in FIGS. 3-5, and described in column 8 lines 1 to 65.

Figure 3B:
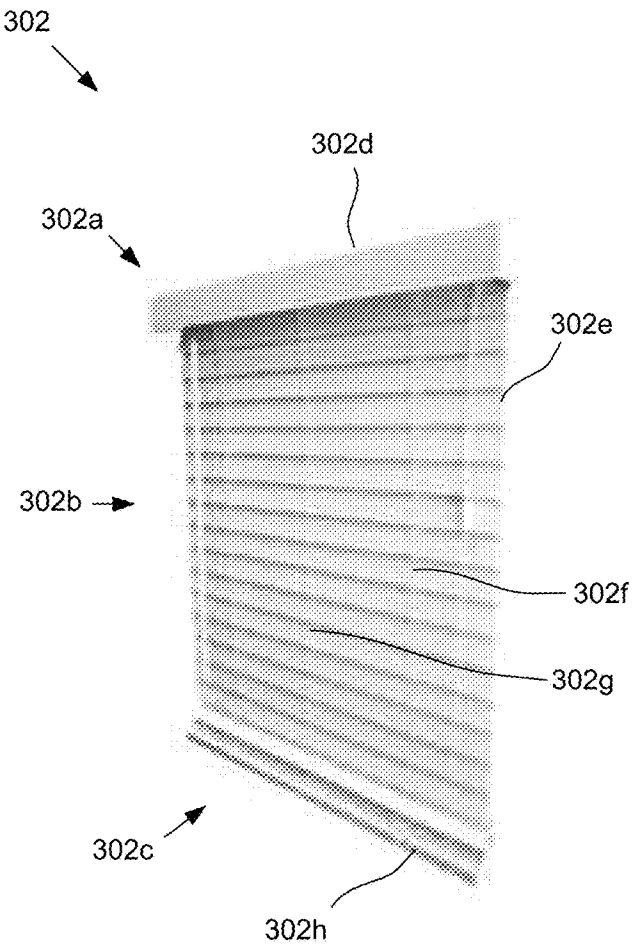
FIGS. 3A-B depict example window covering embodiments.
Figure 3A:
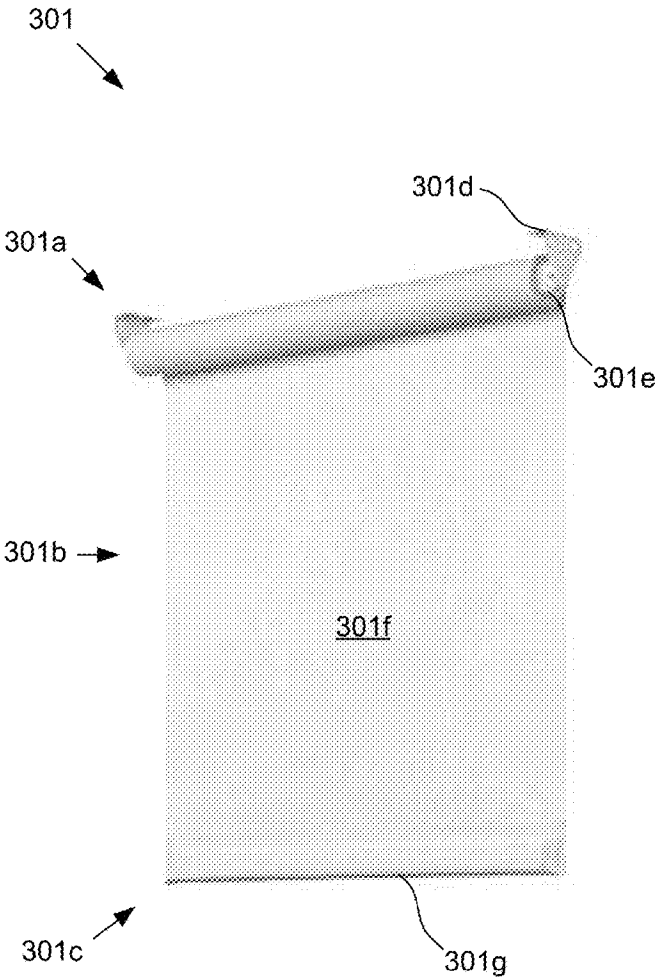

FIGS. 3A-B depict example window covering embodiments. FIG. 3A depicts a roller shade 301 having a shade deployment assembly 301*a*, a shade 301*b* and a bottom portion 301*c*. The shade deployment assembly includes mounting brackets 301*d* and a roller tube 301*e*. The shade includes a flexible polymer panel 301*f*. The bottom portion includes a battery 301*g*. The flexible polymer panel is wrapped around and surrounds the battery. Wiring is embedded in the flexible panel and electrically couples the battery to a motor disposed within the roller tube. FIG. 3B depicts a venetian blind 302 having a shade deployment assembly 302*a*, a shade 302*b*, and a bottom portion 302*c*. The shade deployment assembly includes a headrail 302*d* that houses a tilt rod, a motor and bobbins. The shade includes horizontal vinyl slats 302*e*, strings 302*f*, and wiring 302*g*. The bottom portion includes a slat-shaped battery 302*h*. The wiring passes around and beneath the battery and electrically couples to the battery beneath the battery, thus giving the appearance that the wiring is simply another string, thereby camouflaging the wiring. The design of the battery to look similar to the slats also camouflages the battery, though the battery remains exposed.

Figure 4A:
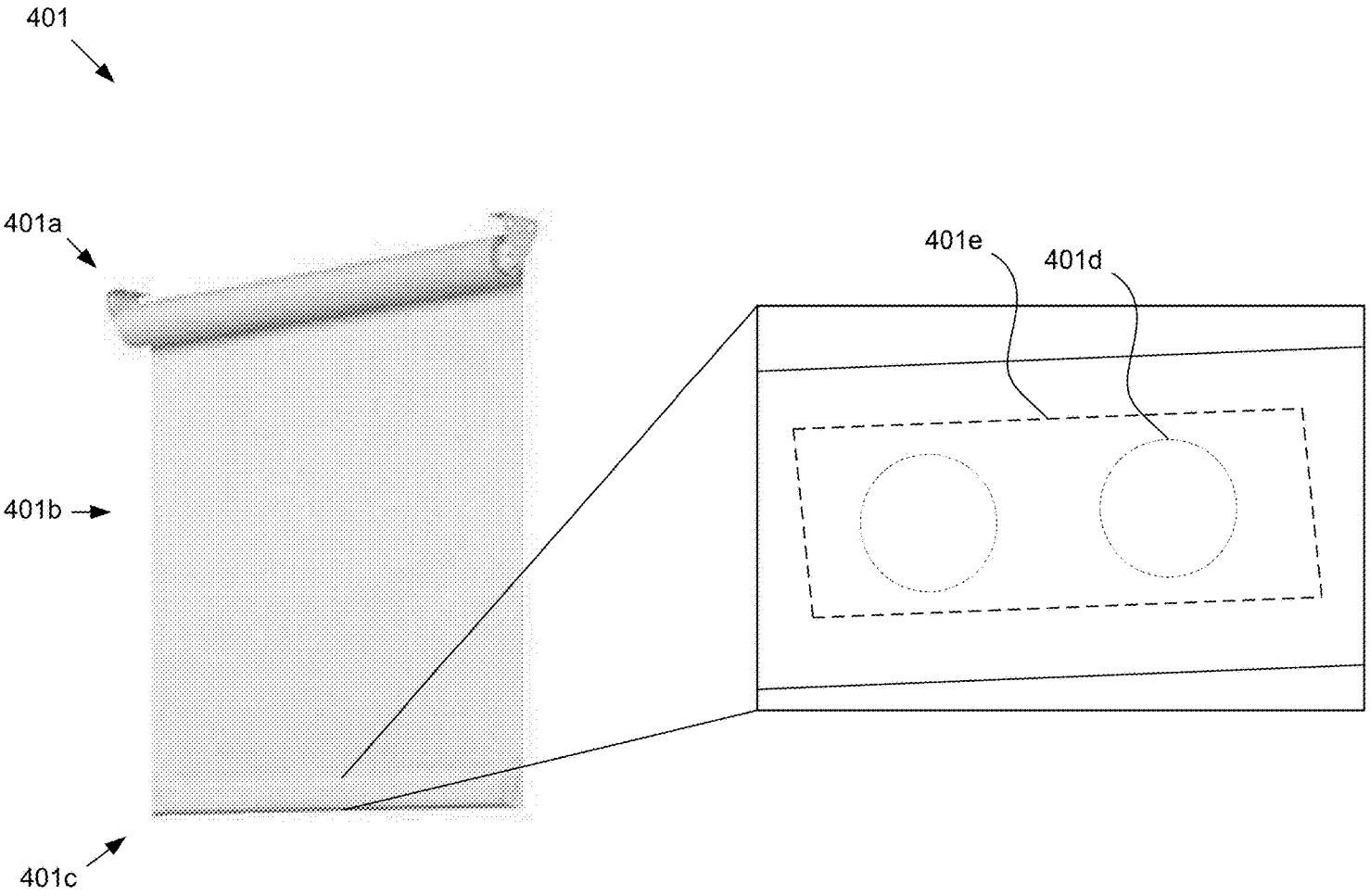
FIGS. 4A-B depict example window covering embodiments with control buttons disposed on the bottom portion.
Figure 4B:
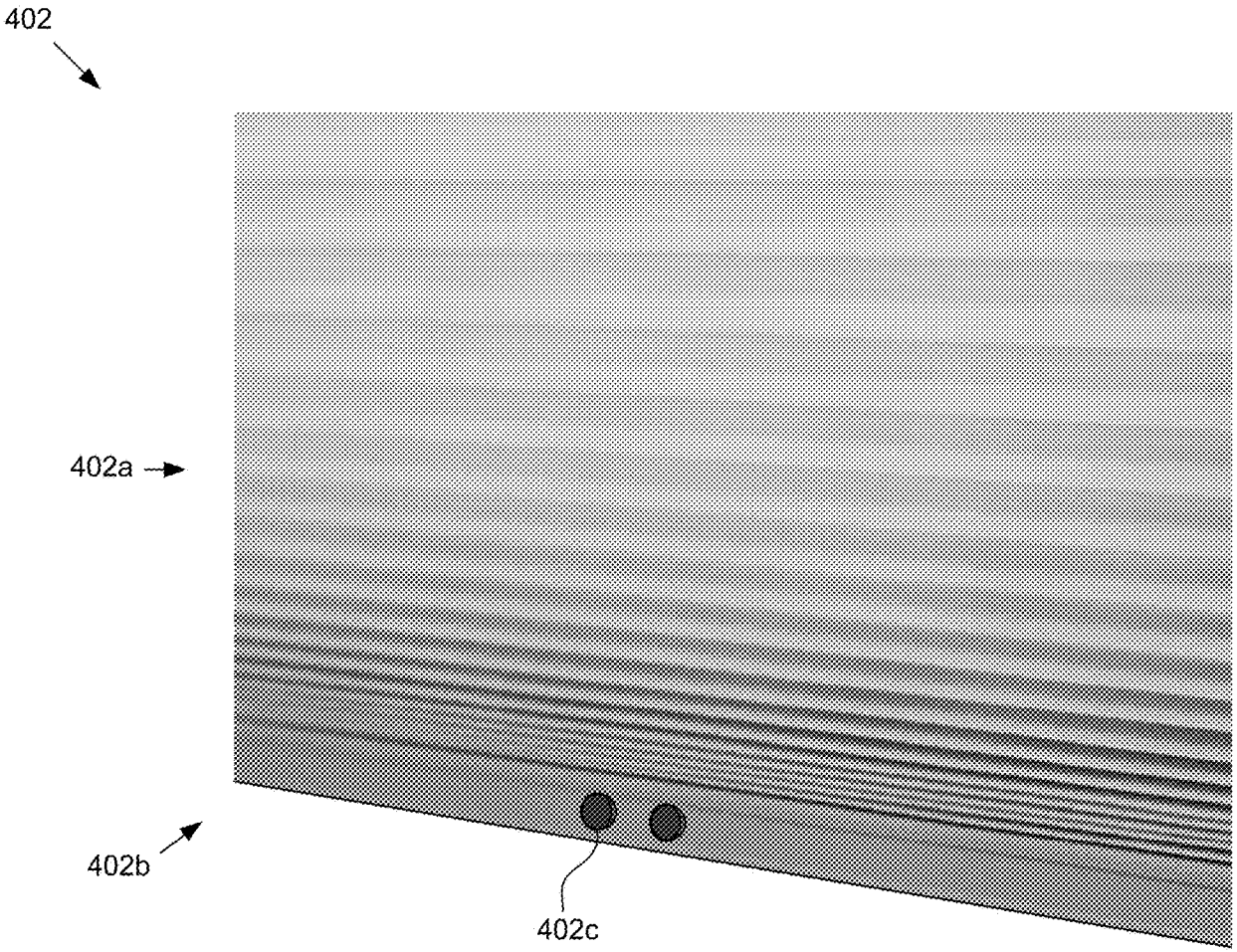

FIGS. 4A-B depict example window covering embodiments with control buttons disposed on the bottom portion. FIG. 4A depicts a roller shade 401 having a shade deployment assembly 401*a*, a shade 401*b*, a bottom portion 401*c*, control buttons 401*d* and printed circuit board (PCB) 401*e*. The control buttons and PCB are hidden beneath the shade and electrically connected to a motor disposed in the shade deployment assembly by wiring embedded in the shade. FIG. 4B depicts part of a cellular blind system 402. The blind system includes a shade 402*a*, a bottom portion 402*b*, and exposed control buttons 402*c*. The control buttons are electrically coupled to a printed circuit board (PCB) disposed in the bottom portion. The PCB is electrically coupled to a battery also disposed in the bottom portion and a motor disposed in a shade deployment assembly (not depicted).

Figure 5:
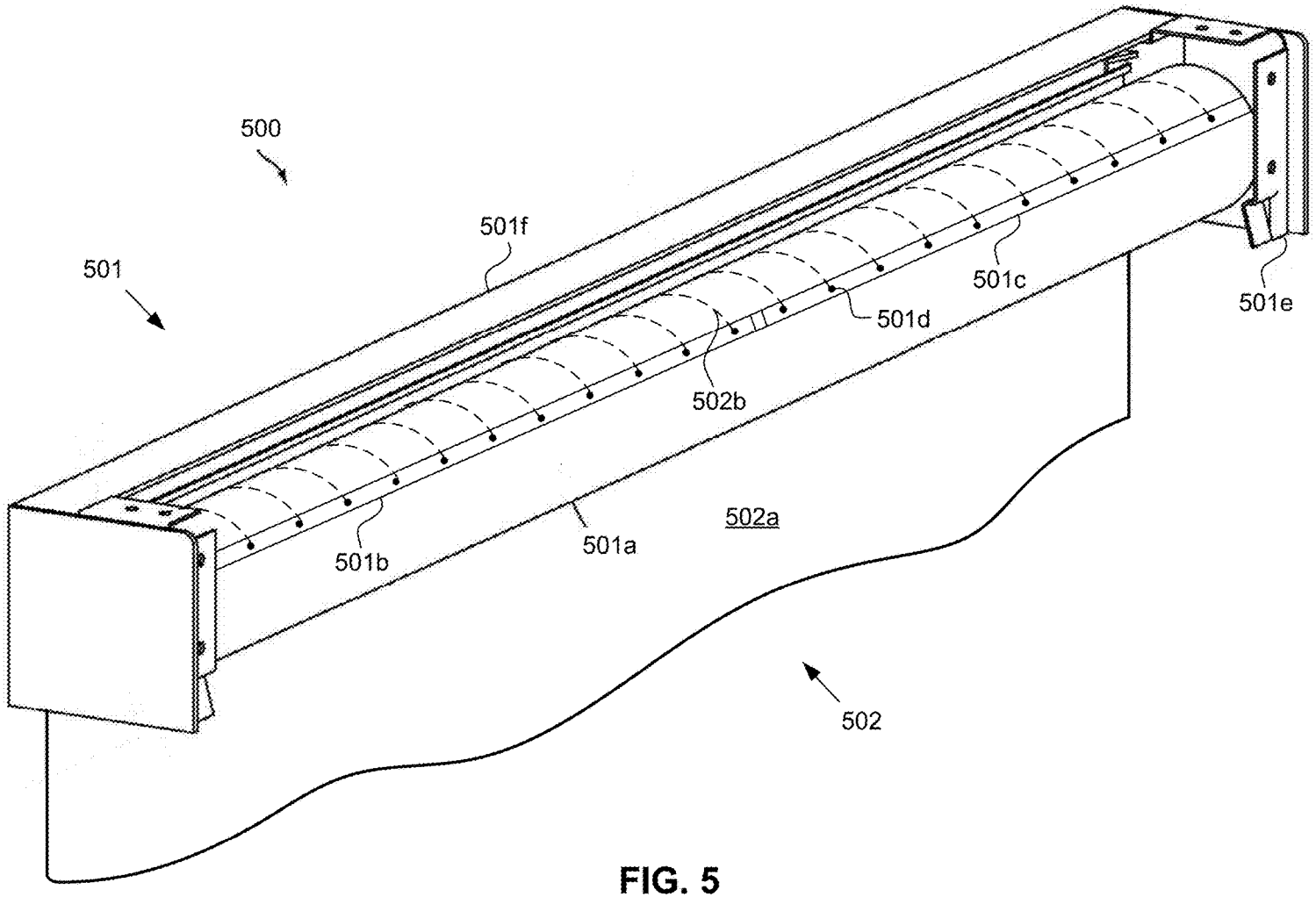
FIG. 5 depicts an unrolled roller shade.

FIG. 5 depicts an unrolled roller shade. The roller shade 500 includes a shade deployment assembly 501 and a shade 502. The shade deployment assembly includes a tube 501*a*, left-side copper strip 501*b*, a right-side copper strip 501*c*, conductive grommets 501*d*, mounting brackets 501*e*, and a headrail 501*f* The shade includes a flexible fabric panel 502*a* and wiring 502*b*. The wiring is woven into the flexible fabric panel. The panel is connected to the tube by the conductive grommets, and the wiring is fused to the grommets. The grommets are electrically coupled to the copper strips. The strips represent positive and negative sides of a circuit formed by the wiring and strips. The strips are coupled to conductors that pass through the tube to the motor. Although in the depicted embodiment power strips are shown, more conductive material may be included for data transmission, as well.

Figure 6:
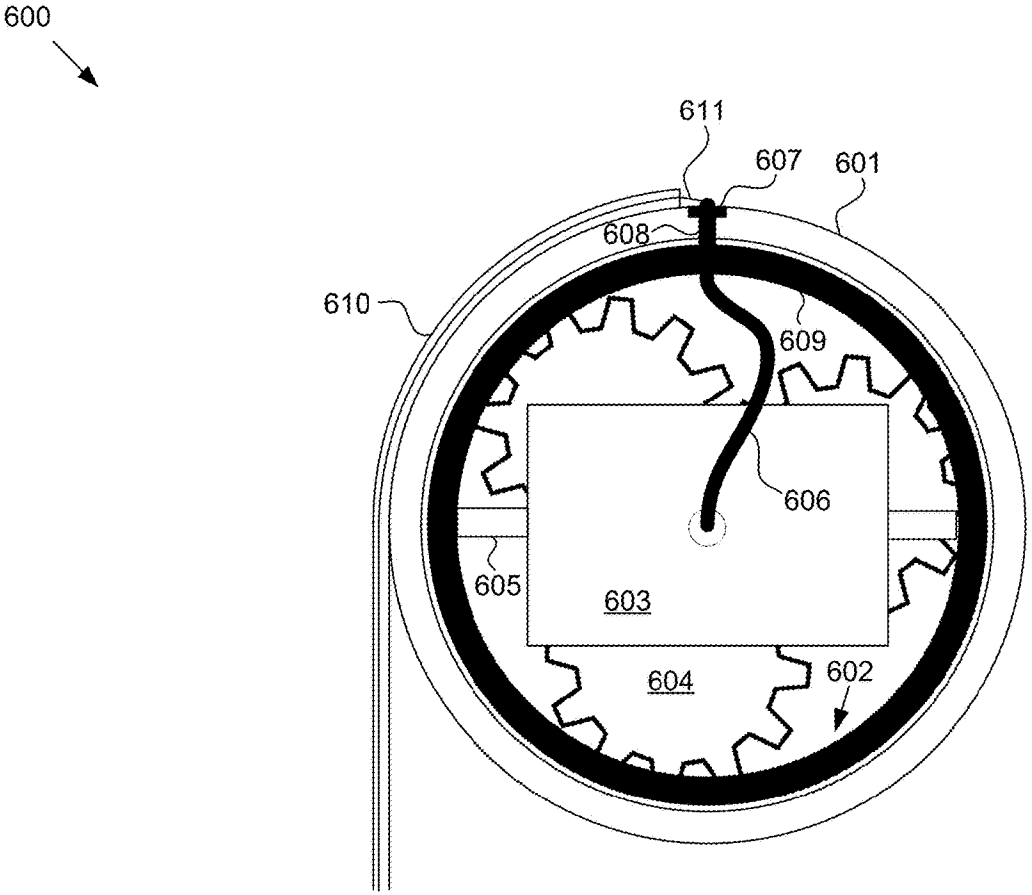
FIG. 6 depicts a side cross-section of a shade deployment assembly of a roller shade.

FIG. 6 depicts a side cross-section of a shade deployment assembly of a roller shade. The shade deployment assembly 600 includes a rotatable tube 601, a fixed tube 602, a motor 603, a transmission 604, standoffs 605, a power line 606, a conductive strip 607, a conductive brush 608, a slip ring 609, a flexible panel 610 and wiring 611. The wiring is soldered to the conductive strip. The conductive strip is embedded in the rotatable tube. The conductive brush extends through the rotatable tube and contacts the slip ring. The slip ring is disposed in the rotatable tube. The power line is connected to the slip ring and the motor. The motor is supported by the standoffs, which are connected to the fixed tube. The transmission engages with the rotatable tube, allowing the motor to rotate the rotatable tube.

Figure 7:
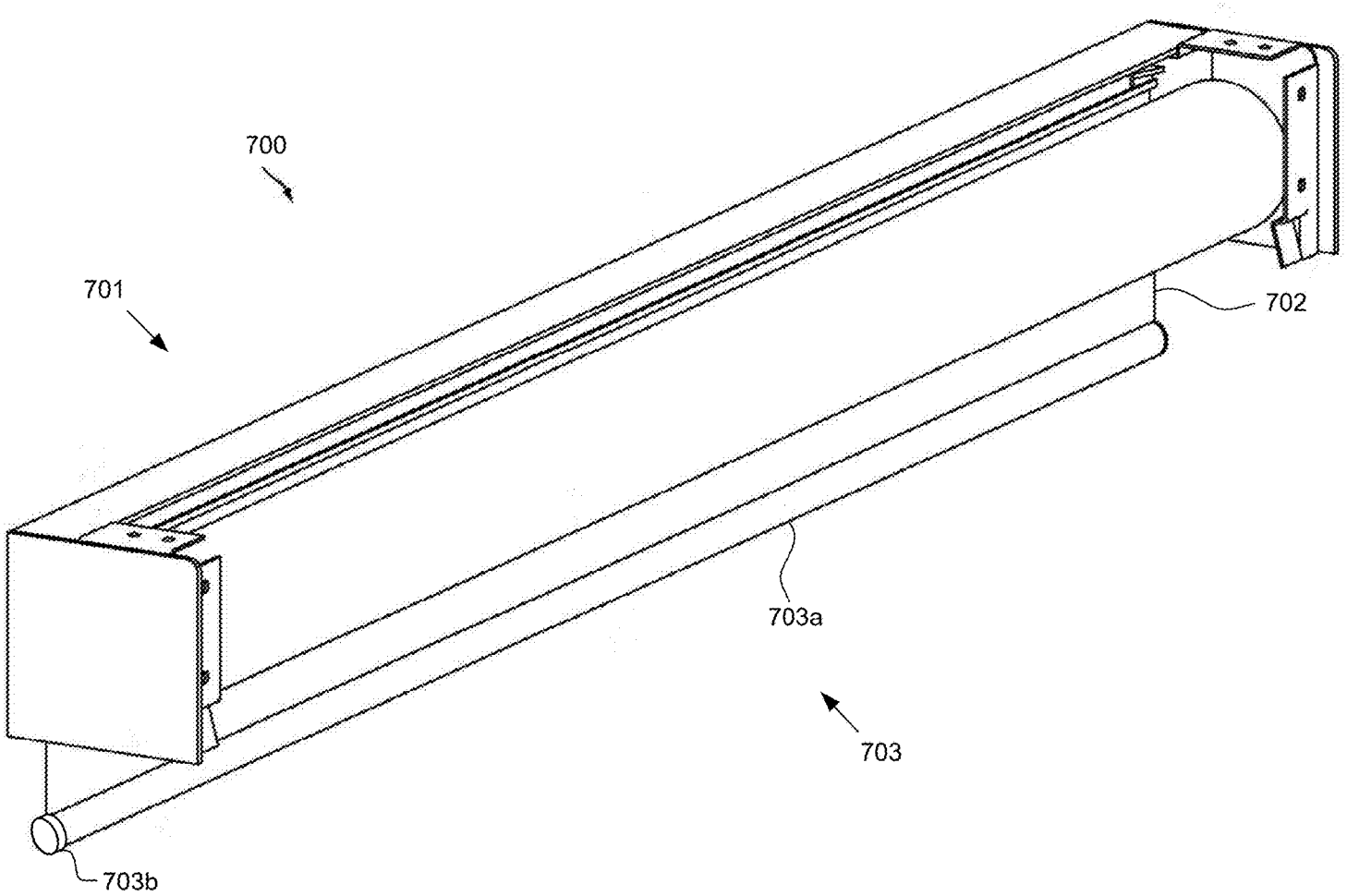
FIG. 7 depicts an isometric view of a roller shade.

FIG. 7 depicts an isometric view of a roller shade. The roller shade 700 includes a shade deployment assembly 701, a shade 702, and a bottom portion 703. The bottom portion includes a tube 703*a* and a removable cap 703*b*.

Figure 8A:
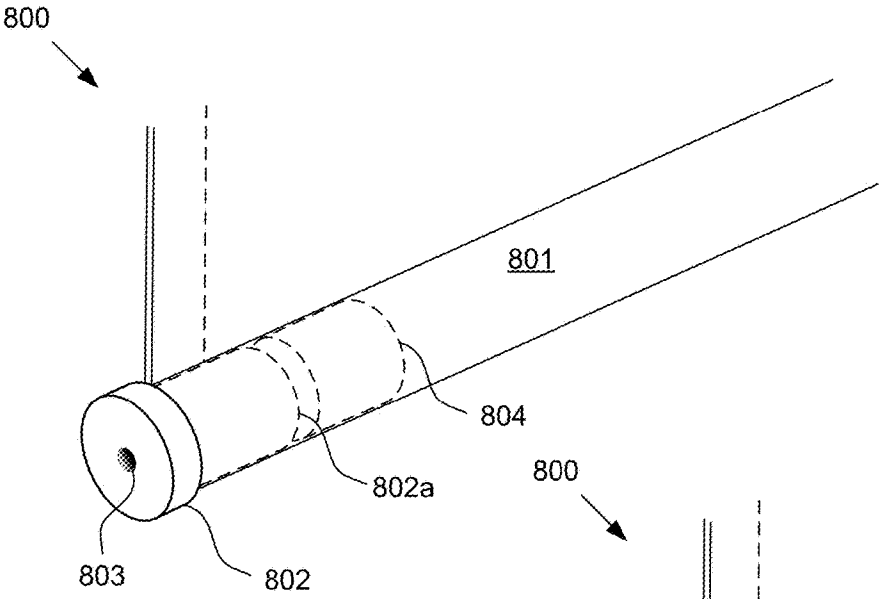
FIGS. 8A-B depict views of a bottom portion of a roller shade.
Figure 8B:
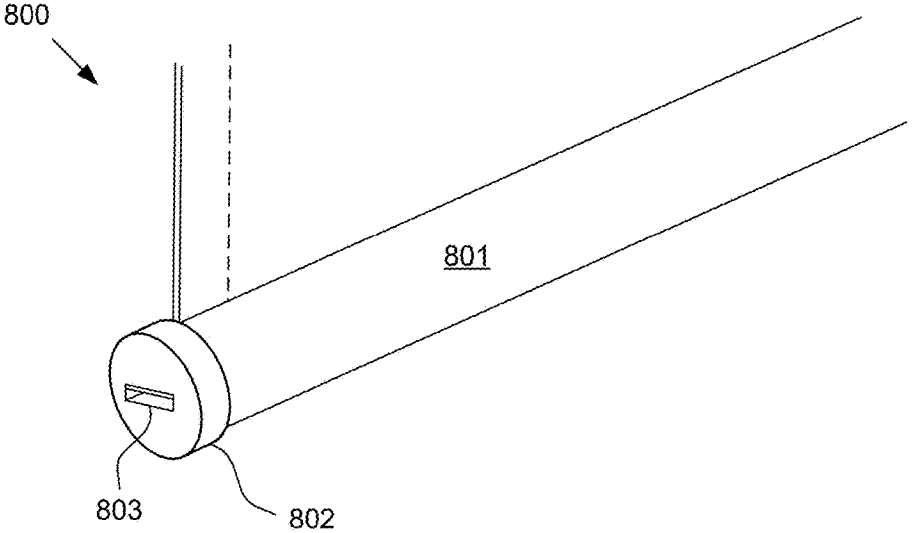

FIGS. 8A-B depict views of a bottom portion of a roller shade. The bottom portion 800 includes a tube 801, a removable cap 802, and a port 803. In FIG. 8A the port is a power port. FIG. 8A also depicts a power port control unit 802*a* and a battery 804. The battery is disposed in the tube and electrically connected to the power control unit. The power control unit may regulate recharging of the battery. In FIG. 8B the port is a data port. Though not shown, in some embodiments, the removable cap may include power and data ports. Also, in various embodiments, the removable cap may be excluded, and the port(s) may be disposed directly on the tube. The removable cap may include a printed circuit board and/or a power transformer, both of which extend into the tube. The removable cap may also include a mechanism, such as a spring, for securing one or more batteries within the tube and ensuring electrical contact between the batteries, the removable cap, and other electrical contacts disposed within the tube.

Figure 9:
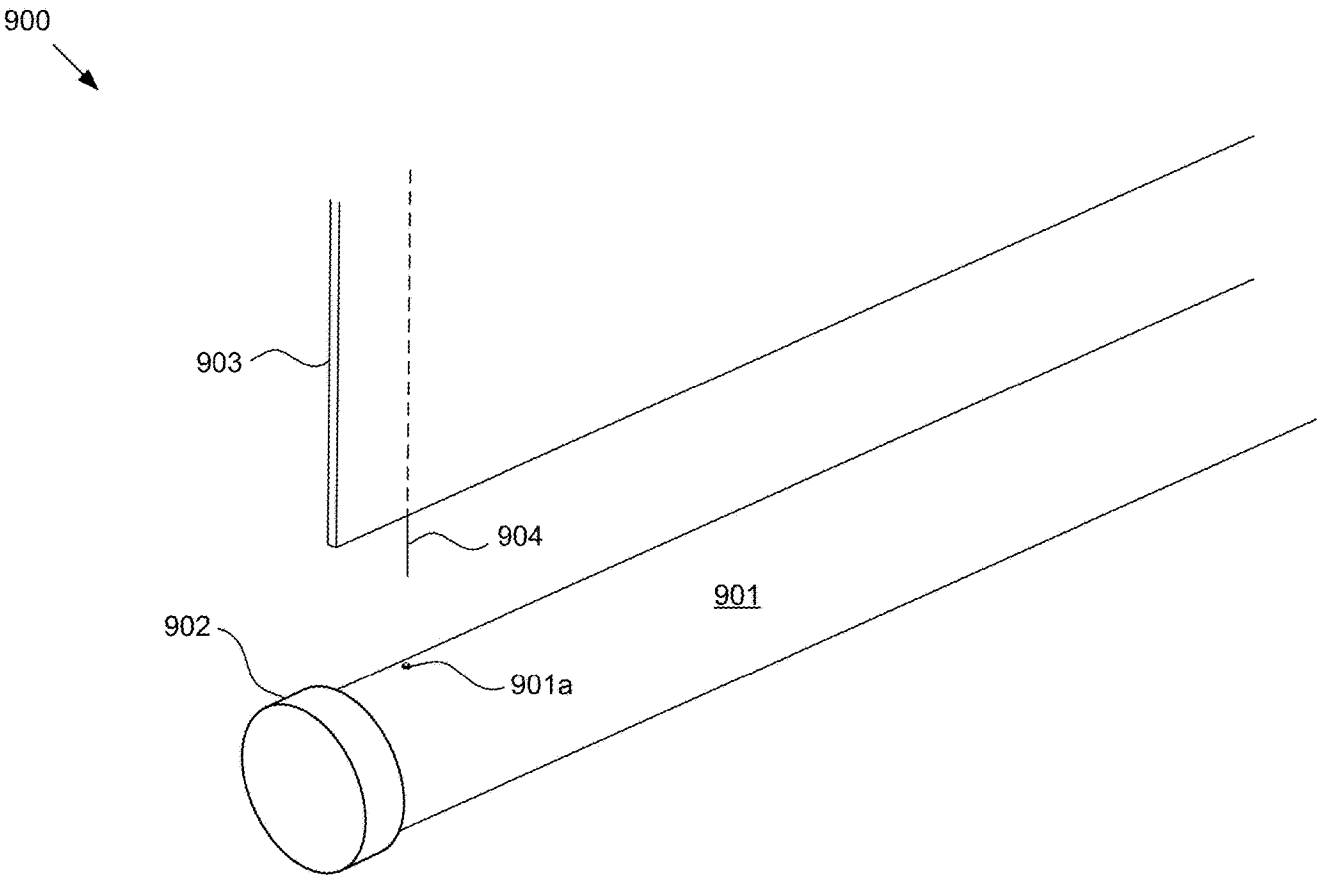
FIG. 9 depicts a partially exploded view of a bottom portion of a roller shade.

FIG. 9 depicts a partially exploded view of a bottom portion of a roller shade. The bottom portion 900 includes a tube 901, a removable cap 902, a flexible panel 903, and wiring 904. The wiring is embedded in the flexible panel and extends into the tube via an opening 901*a*. The flexible panel may wrap around the tube, or may otherwise be affixed to the tube.

Figure 10:
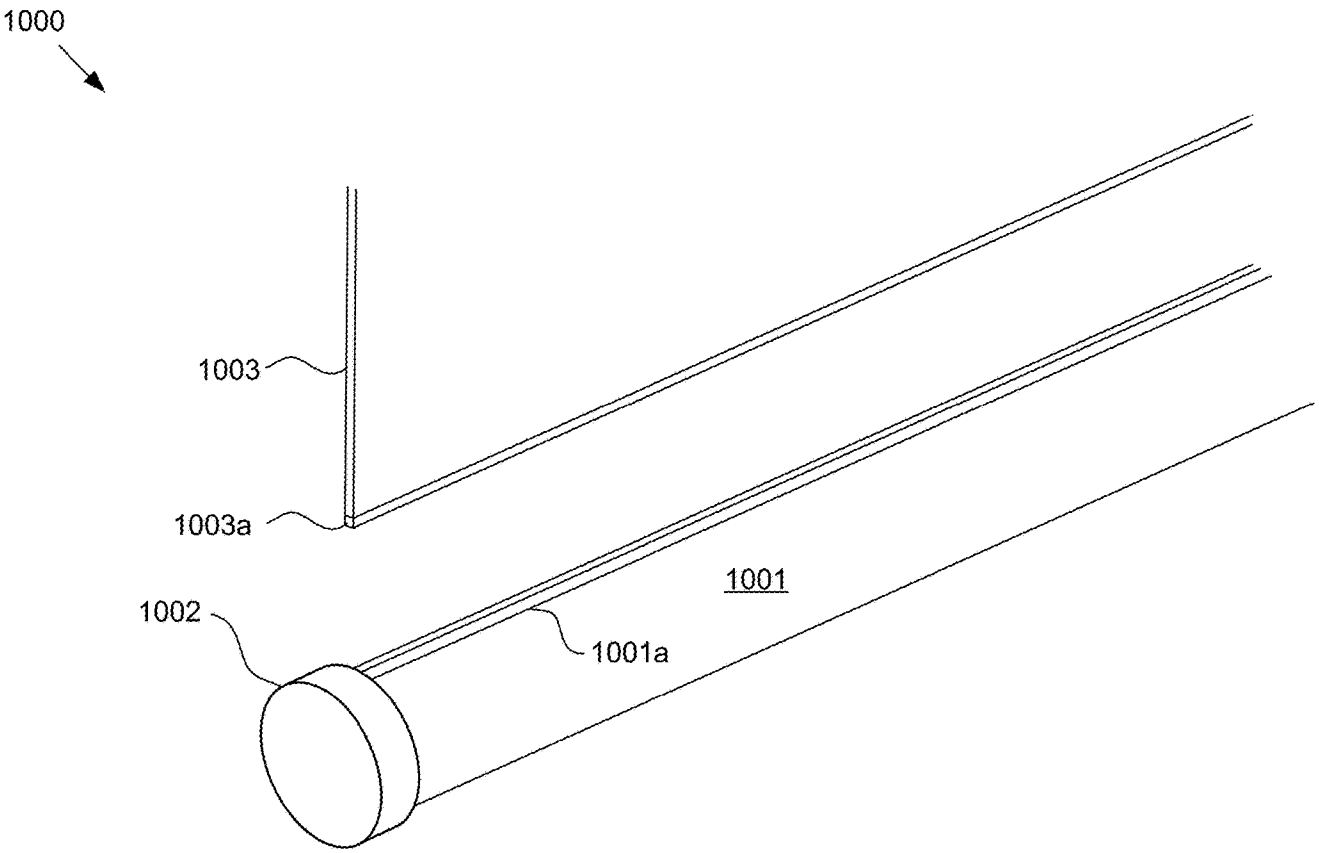
FIG. 10 depicts another partially exploded view of a bottom portion of a roller shade.

FIG. 10 depicts another partially exploded view of a bottom portion of a roller shade. The bottom portion 1000 includes a tube 1001, a cap 1002, and a flexible panel 1003. The tube includes a groove 1001*a* into which the flexible panel fits. The groove is comprised of a magnetic material. The flexible panel includes a magnetic material 1003*a* along a portion of the panel that fits into the groove. The magnetic materials in the tube may be electromagnetic. Control electronics disposed in the tube may activate the magnetic material to affix the tube to the panel with enough force to resist an amount of force that may be required to manually extend the roller shade. A battery is disposed in the tube and is electrically coupled to wiring integrated into the flexible panel.

Figure 11B:
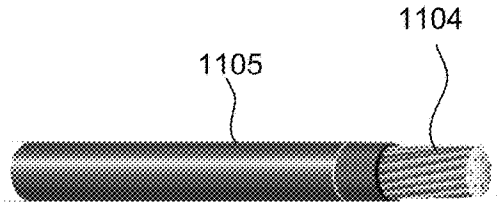
FIGS. 11A-C depict various views of wiring.
Figure 11C:
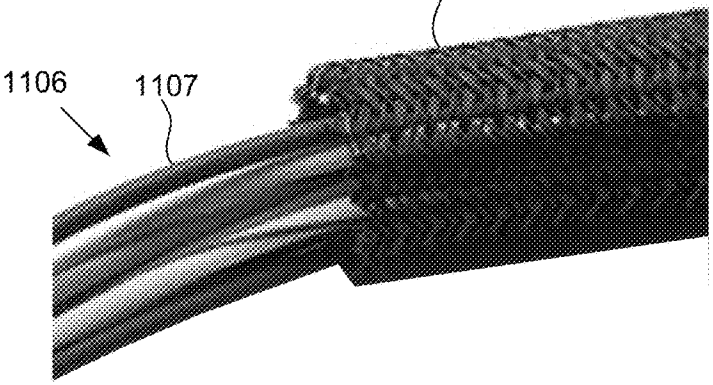
Figure 11A:
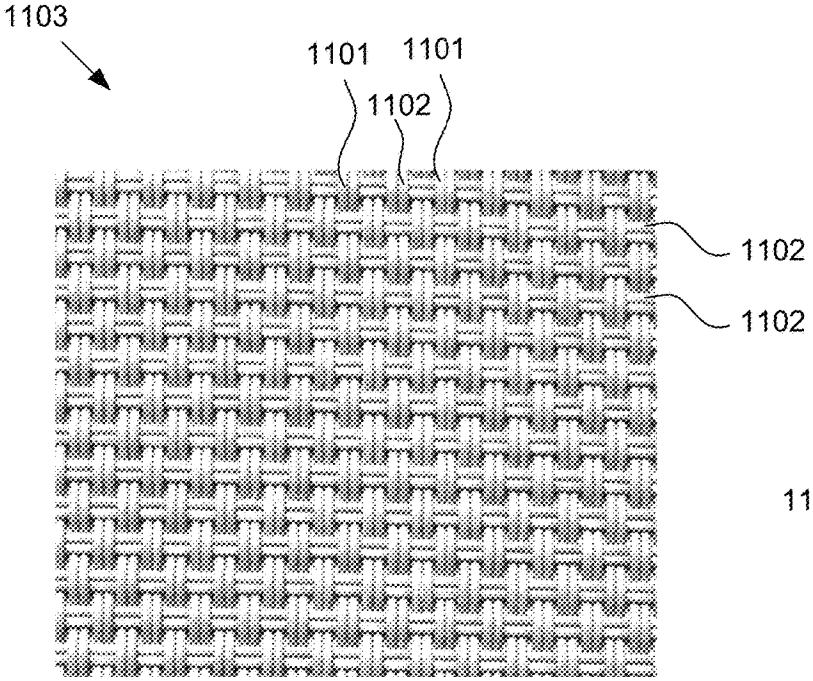

FIGS. 11A-C depict various views of wiring. In FIG. 11A, wiring 1101 is interwoven with fabric strands 1102 to form a flexible panel 1103. Sheathing of the wiring may correspond to a color and/or design of the fabric strands to camouflage the wiring in the panel. Each individual wire includes a single-stranded copper core and a sheath. FIG. 11B depicts one embodiment of wiring that may be embedded in a flexible panel. The wiring includes conductive strands 1104 and a sheath 1105. FIG. 11C depicts another embodiment of wiring. Individual conductive strands 1106 include sheathing 1107, and are bound by an external sheath 1108. The external sheath may have a design corresponding to one or more strings on the window covering to camouflage the wiring.

Figure 12:
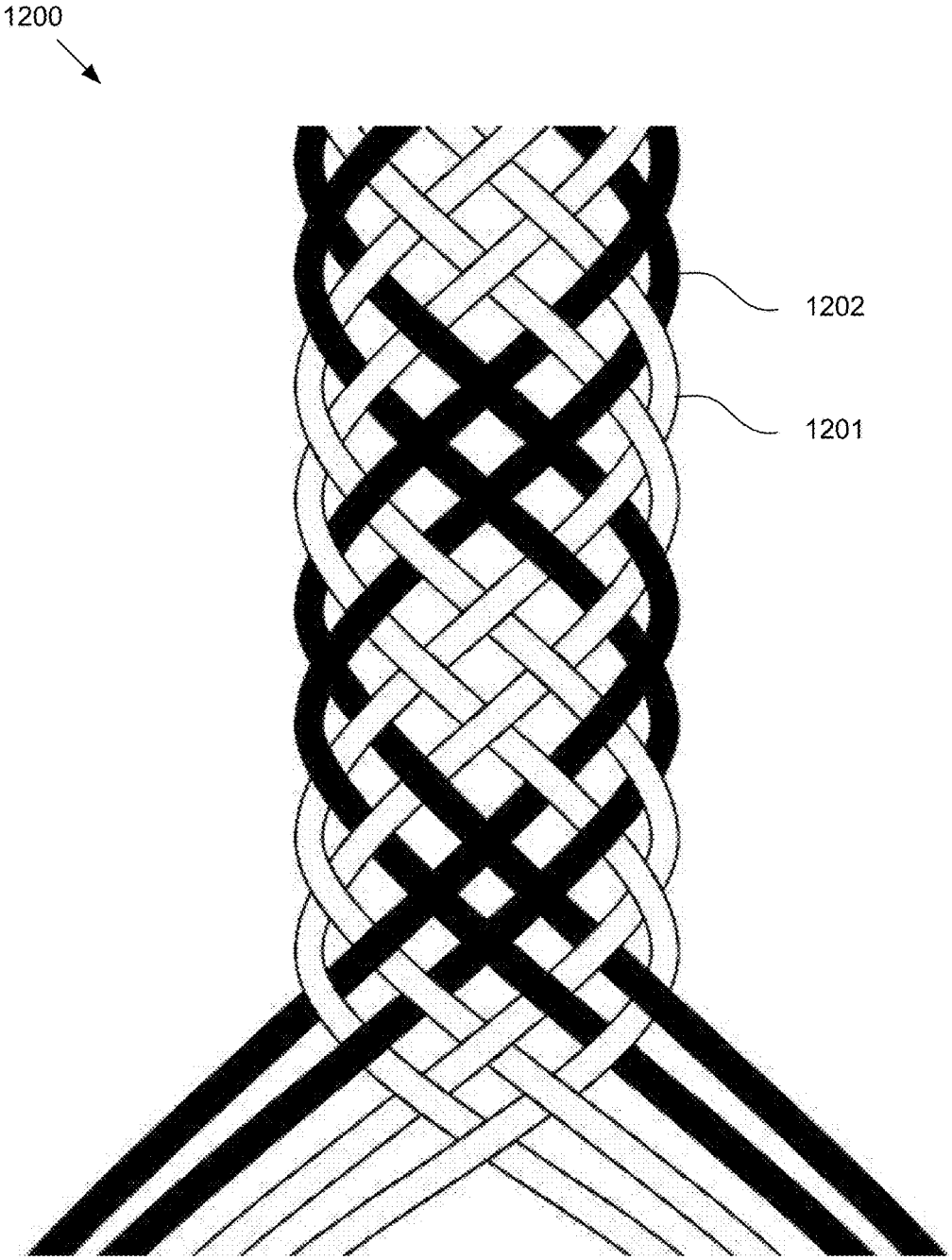
FIG. 12 depicts another embodiment of a string.

FIG. 12 depicts another embodiment of a string. The string 1200 includes polymer strands 1201 and wiring 1202. The polymer strands and wiring are interwoven to form the string. Each wire includes a single-stranded copper core and a sheath. Each strand may include one or more polymer filaments.

Figure 13A:
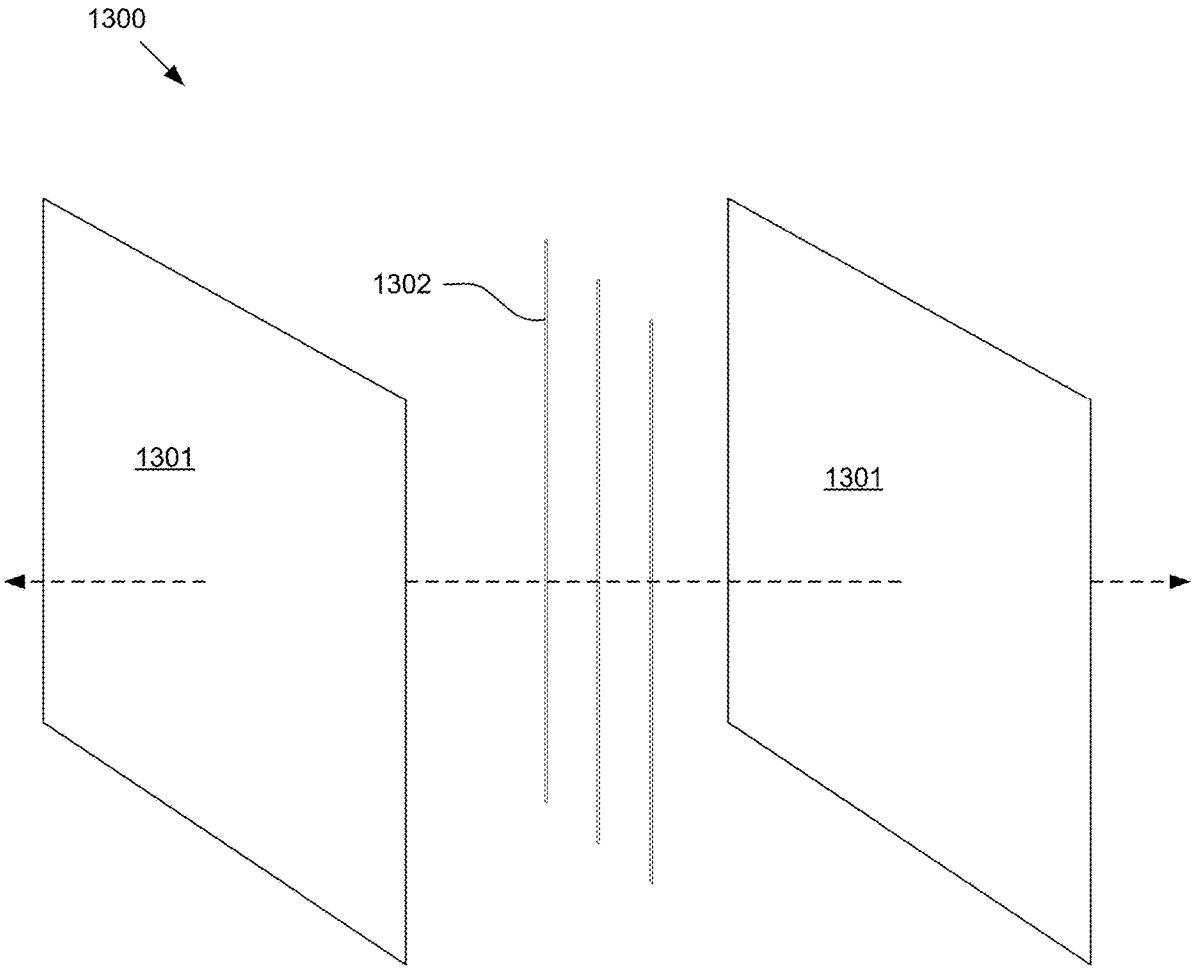
FIGS. 13A-C depict various views of a flexible polymer panel with embedded wiring.
Figure 13C:
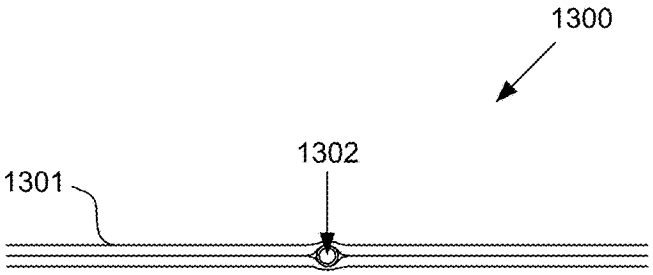
Figure 13B:
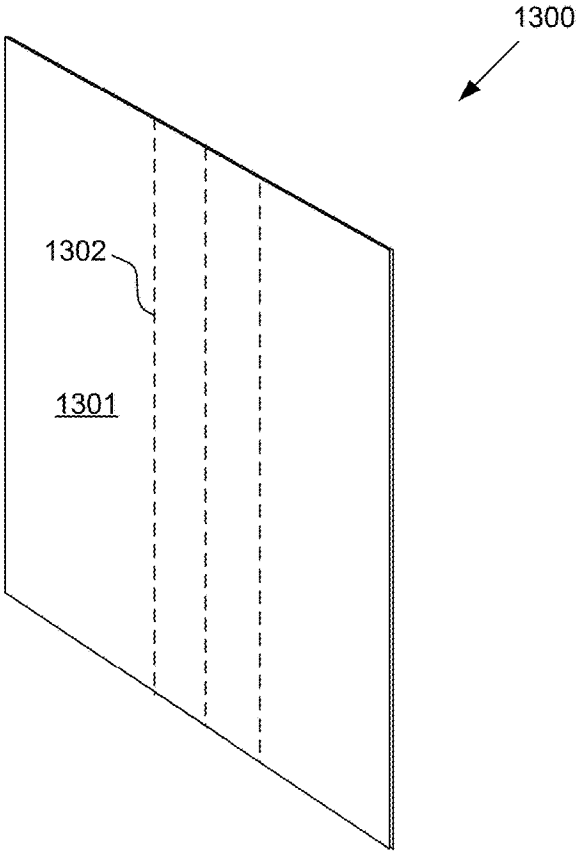

FIGS. 13A-C depict various views of a flexible polymer panel with embedded wiring. The flexible polymer panel 1300 includes two thermoplastic sheets 1301 and wiring 1302. The wiring is disposed between the thermoplastic sheets. The thermoplastic sheets are heated to bond to each other and sheathing around the wiring. The resultant panel may have a thickness ranging from 10 mils to 150 mils.

We claim:

1. A motorized window covering, comprising:

a shade comprising an upper end and a lower end opposite the upper end;

a shade deployment assembly at the upper end that deploys the shade to cover a window, comprising:

a rotatable element connected to the shade that rotates to deploy and retract the shade;

a motor and gear assembly that rotates the rotatable element; and one or more mounting brackets that mount the deployment assembly to a surface; one or more batteries that power the motor, the one or more batteries removably disposed in a housing connected to the shade at the lower end; and wiring disposed in the shade and electrically coupling the motor to the one or more batteries.

2. The motorized window covering of claim 1, wherein the window covering comprises one or more of a roller shade, a cellular shade, a roman shade, a pleated shade, a bamboo shade, or a sheer shade.

3. The motorized window covering of claim 1, wherein the window covering comprises a roller shade, a cellular shade, a roman shade, a pleated shade, a bamboo shade, or a sheer shade, wherein the shade comprises a flexible panel, and wherein the wiring is integrated into the flexible panel.

4. The motorized window covering of claim 1, wherein the window covering comprises a roller shade, a cellular shade, a roman shade, a pleated shade, a bamboo shade, or a sheer shade, wherein the shade comprises a flexible woven panel, and wherein the wiring is woven into the flexible woven panel.

5. The motorized window covering of claim 1, wherein the window covering comprises one or more of venetian blinds, vertical blinds, roman blinds, mini blinds, micro blinds, louvers, jalousies, brise soleil, or pleated blinds.

6. The motorized window covering of claim 1, wherein the window covering comprises venetian blinds, vertical blinds, roman blinds, mini blinds, micro blinds, louvers, jalousies, brise soleil, or pleated blinds, wherein the shade comprises one or more strings connected to the deploying portion, wherein the strings comprise the wiring.

7. The motorized window covering of claim 1, wherein the window covering comprises venetian blinds, vertical blinds, roman blinds, mini blinds, micro blinds, louvers, jalousies, brise soleil, or pleated blinds, wherein the shade comprises one or more strings connected to the deploying portion, wherein the strings comprise the wiring, wherein the wiring is incorporated into at least one of the one or more strings.

8. The motorized window covering of claim 1, wherein the window covering comprises venetian blinds, vertical blinds, roman blinds, mini blinds, micro blinds, louvers, jalousies, brise soleil, or pleated blinds, wherein the shade comprises one or more strings connected to the deploying portion, wherein the strings comprise the wiring, wherein the wiring comprises a set of individually sheathed wires, and wherein the set of sheathed wires is interwoven to form at least one of the strings.

9. The motorized window covering of claim 1, wherein the wiring comprises a set of individually sheathed wires.

10. The motorized window covering of claim 1, wherein the wiring comprises a set of individually sheathed wires, wherein the set comprises an ampacity ranging from 3 Amps to 20 Amps.

11. The motorized window covering of claim 1, wherein the wiring comprises a set of wires, wherein each wire of the set of wires is electrically coupled to a monolithic conductor disposed between the wiring and the motor, wherein the monolithic conductor is connected to the shade deployment assembly and electrically coupled to the motor.

12. The motorized window covering of claim 1, wherein the wiring comprises a sheath having a color scheme corresponding to a color scheme of the shade to camouflage the wiring in the covering portion.

13. The motorized window covering of claim 1, further comprising one or more control buttons electrically coupled to the motor by the wiring, the one or more control buttons disposed at the same end of the shade as the one or more batteries.

14. The motorized window covering of claim 1, further comprising one or more control buttons electrically coupled to the motor by the wiring, the one or more control buttons disposed at the same end of the shade as the one or more batteries, wherein the one or more control buttons are hidden beneath an external design feature of the shade.

15. The motorized window covering of claim 1, wherein the housing comprises a removable end cap over the one or more batteries.

16. The motorized window covering of claim 1, wherein the housing comprises a detachable panel over the one or more batteries.

17. The motorized window covering of claim 1, wherein the battery is detachable from the shade.

18. The motorized window covering of claim 1, wherein the battery is integral with the shade.

19. The motorized window covering of claim 1, wherein the housing comprises a charging port electrically coupled to the one or more batteries.

20. The motorized window covering of claim 1, wherein the housing comprises a data port electrically coupled to one or more of the one or more batteries or the motor.

* * * * *